United States Patent [19]

Hamu

[11] Patent Number: 5,018,442

[45] Date of Patent: May 28, 1991

[54] PRINTING SCREEN STRETCH FRAME

[76] Inventor: Kaino J. Hamu, 16061 Dominica Cir., Huntington Beach, Calif. 92649

[21] Appl. No.: 455,933

[22] Filed: Dec. 19, 1989

Related U.S. Application Data

[63] Continuation of Ser. No. 216,967, Jul. 11, 1988, abandoned.

[51] Int. Cl.[5] ..... B05C 17/08

[52] U.S. Cl. ..... 101/127.1; 38/102.91

[58] Field of Search ..... 38/102.7, 102.8, 102.9, 38/102.91, 102-102.6; 101/127.1, 415.1; 272/65

[56] References Cited

U.S. PATENT DOCUMENTS

| | | | |
|---|---|---|---|
| 2,350,236 | 5/1944 | Johnson | 160/398 |
| 3,211,089 | 10/1965 | Messerschmitt | 160/378 |
| 3,485,165 | 12/1969 | Hughes | 101/127.1 |
| 3,553,862 | 1/1971 | Hamu | 38/102.1 |
| 3,601,912 | 8/1971 | Dubbs | 101/127.1 |
| 3,908,293 | 9/1975 | Newman | 38/102.91 |
| 3,962,805 | 6/1976 | Hamu | 101/127.1 |
| 3,987,835 | 10/1976 | Bloomfield | 101/127.1 |
| 4,037,640 | 7/1977 | Hubbard | 38/102.91 |
| 4,041,861 | 8/1977 | Alter | 38/102.91 |
| 4,060,030 | 11/1977 | Noschese | 101/127.1 |
| 4,209,888 | 7/1980 | Glasscock, Sr. | 29/263 |
| 4,345,390 | 8/1982 | Newman | 38/102.91 |
| 4,409,749 | 10/1983 | Hamu | 38/102.91 |
| 4,430,814 | 2/1984 | Wulc | 101/127.1 |
| 4,525,909 | 7/1985 | Newman | 38/102.91 |
| 4,563,030 | 1/1986 | Makino | 294/81.4 |

*Primary Examiner*—Edgar S. Burr
*Assistant Examiner*—Moshe I. Cohen
*Attorney, Agent, or Firm*—Boniard I. Brown

[57] ABSTRACT

An improved printing screen stretch frame of the kind having rollers which grip the screen edges and are rotatable to stretch the screen edgewise. The rollers have a unique sealed tubular construction and are coupled at their ends to roller support brackets in a novel way which minimizes or eliminates many costly machining operations that are involved in fabricating conventional stretch frames. The preferred stretch frame has four roller mounting brackets situated at the four corners of a rectangle and rollers coupled at their ends to the adjacent brackets to form a stretch frame consisting of only the rollers and roller mounting brackets.

20 Claims, 2 Drawing Sheets

FIG-.1A
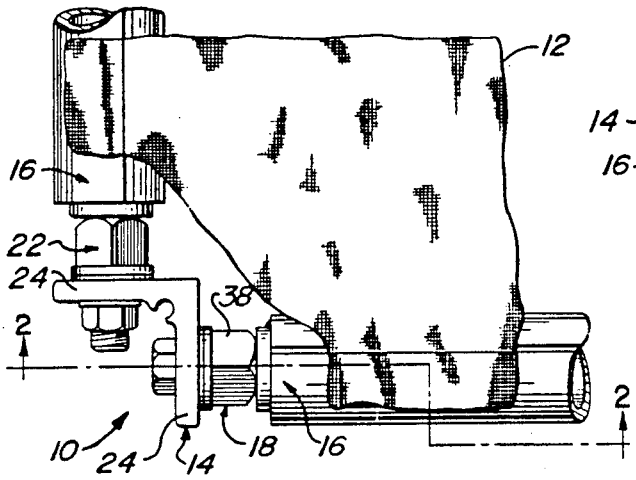
FIG-.1
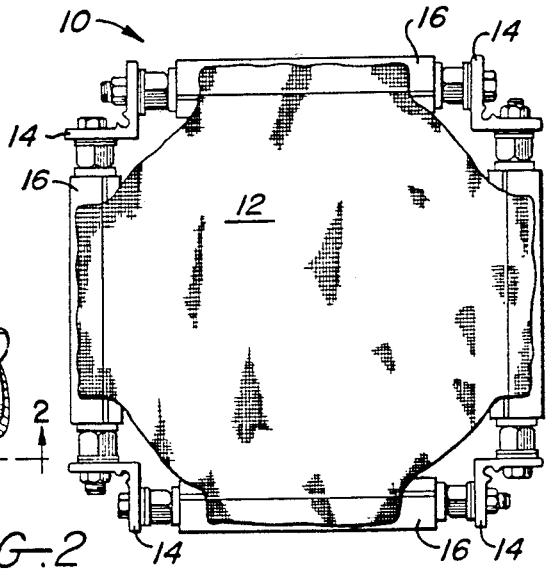
FIG-.2
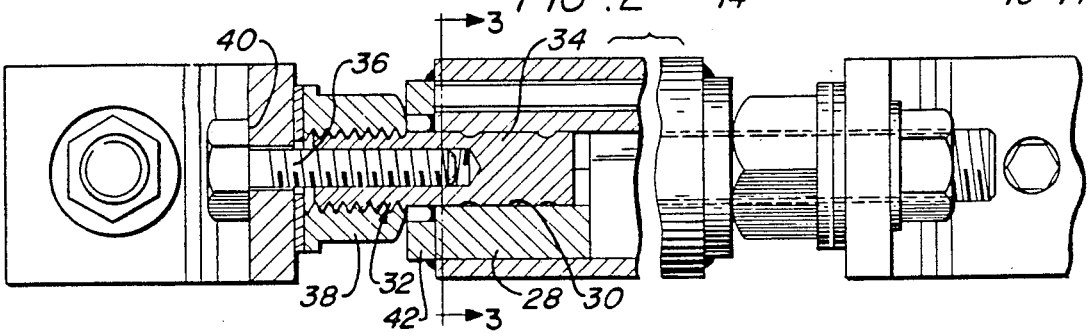
FIG-.3
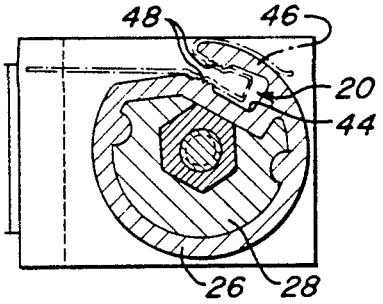
FIG-.5
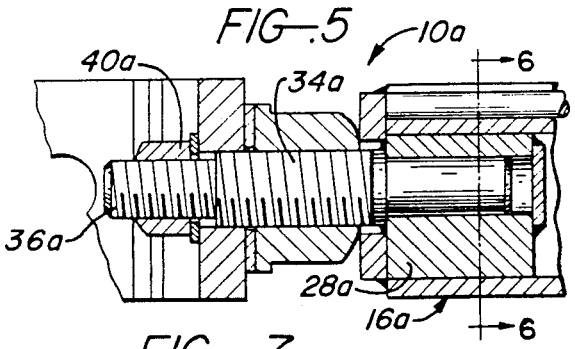
FIG-.4
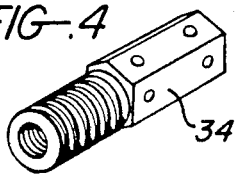
FIG-.7
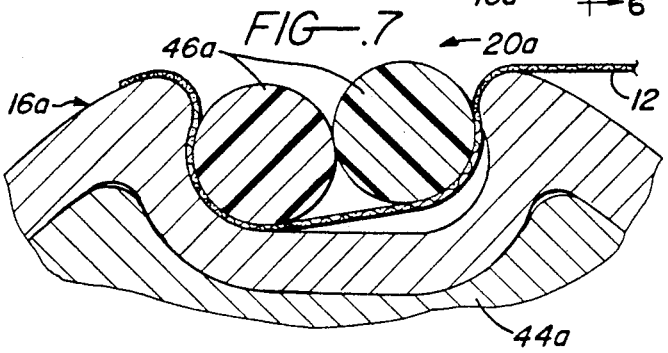

FIG-.8
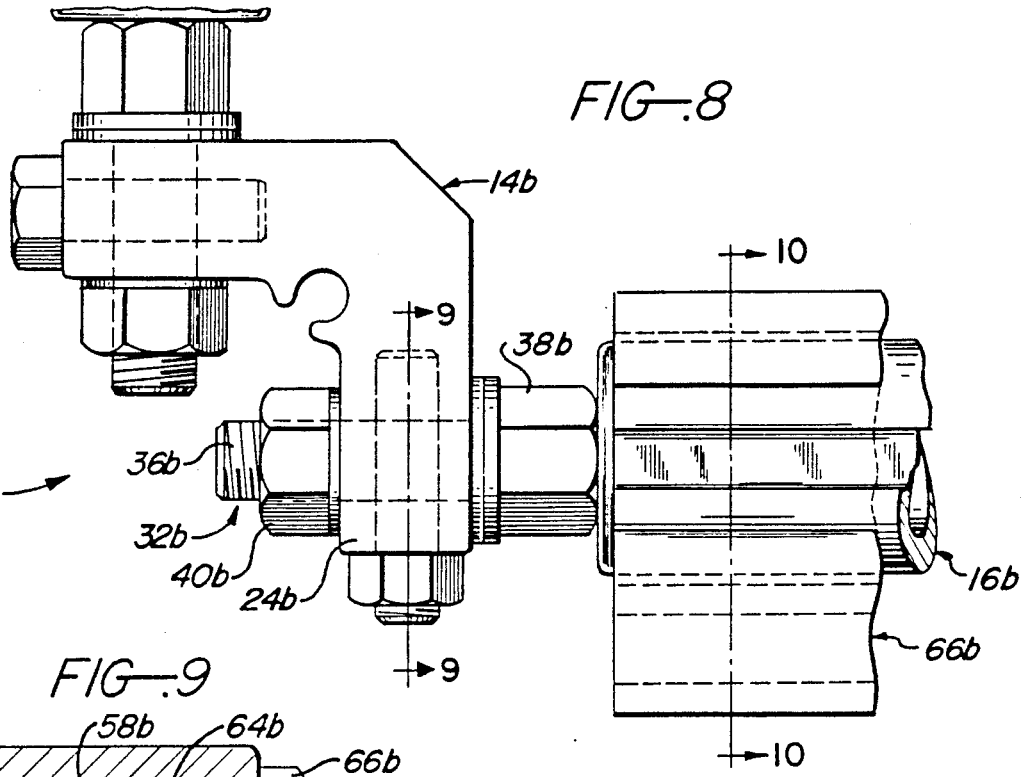
FIG-.9
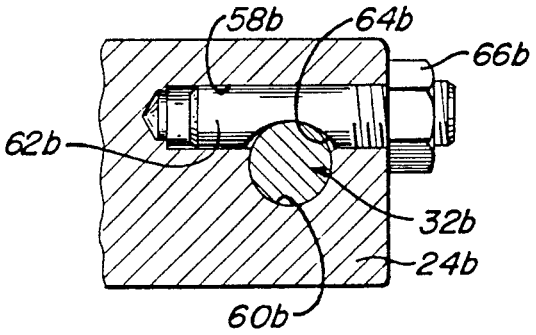
FIG-.10
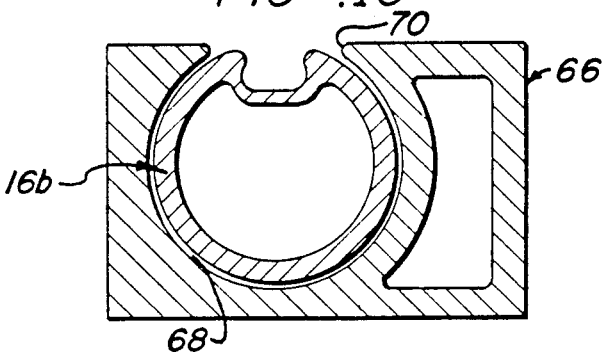
FIG-.11
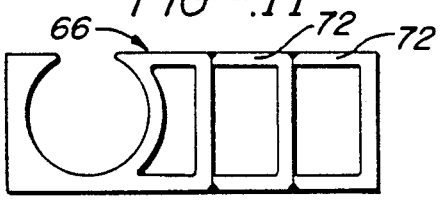
FIG-.6
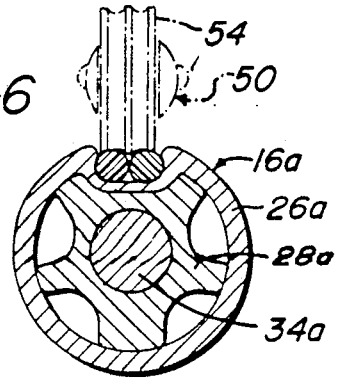
FIG-.12
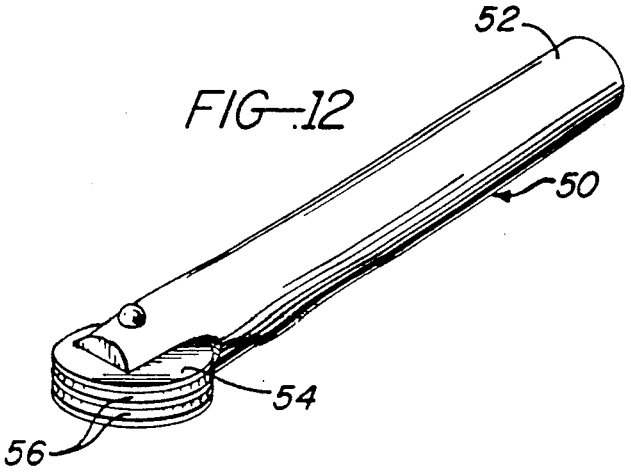

PRINTING SCREEN STRETCH FRAME

This is a continuation of co-pending application Ser. No. 06/216,967, filed on July 11, 1988 now abandoned.

BACKGROUND OF THE INVENTION

1. Field of the Invention

This invention relates generally to screen printing equipment and more particularly to an improved stretch frame structure for printing screens.

2. Discussion of the Prior Art

In the printing process commonly known as silk screen printing or silk screening and referred to herein simply as screen printing, an image to be printed is permanently formed on a printing screen by photo-etching or other technique which blocks the screen openings in a way that defines the image. Ink is then forced through the unblocked screen openings onto a printing surface to reproduce the image on the surface. Effective high quality screen printing with good registration and resolution in the finished print requires maintenance of the printing screen in a very taut and stable condition during the printing operation. To this end, the printing screen is supported in a stretch frame or screen chase having means for gripping the edges of the screen and stressing the screen edgewise.

A variety of printing screen stretch frames have been devised. Examples of such stretch frames are described in the following U.S. Pat. Nos.: 3,553,862; 3,908,293; 4,409,749. While these existing stretch frames are quite satisfactory in many respects, they do have at least one common disadvantage. This disadvantage resides in their relatively complex and costly construction involving many different parts which must be machined or otherwise specially fabricated and then assembled into a finished frame structure. Accordingly, there is a definite need for an improved stretch frame structure having a simplified, less costly construction.

SUMMARY OF THE INVENTION

This invention provides such an improved stretch frame structure for printing screens. According to one feature of the invention, the improved stretch frame structure comprises four roller mounting brackets situated at the four corners of a rectangle and rollers disposed along the four sides, respectively, of the rectangle and coupled at their ends to the brackets in a manner to form a relatively rigid frame structure composed of only the brackets and rollers and wherein the brackets are joined by the rollers only. In other words, the improved frame structure has no rigid frame separate from the rollers for mounting the roller brackets as in a conventional stretch frame. The rollers have means for gripping the edges of a printing screen spanning the frame structure and are rotatable to wind the screen edges on the rollers and thereby stretch the screen edgewise.

According to another feature of the invention the stretch frame rollers are uniquely constructed for fabrication with a minimum of costly machining operations. Each roller comprises a tube having coupling means at its ends engaging and supporting the roller on the adjacent roller support brackets. These roller coupling means comprise plugs fixed within the ends of the roller tube and containing axial openings coaxial with the tube. Fixed within these axial openings are shafts having outer threaded portions extending coaxially beyond the tube ends and shaft extensions extending coaxially from the threaded shaft portions and rotatably through the adjacent roller support brackets. Threaded on the threaded shaft portions are nuts which are engageable by wrenches for rotating the roller and provide shoulders about the roller shafts at one side of the support brackets. About the shaft extensions are shoulders at the opposite sides of the brackets. The shoulders at each end of the roller are relatively axially movable into and from clamping engagement with the intervening roller support bracket to secure the roller against rotation. In one preferred embodiment, each roller shaft extension is a bolt which is threaded in the respective threaded shaft portion for rotation to releasably clamp the respective roller support bracket between the bolt head and the nut on the adjacent threaded roller shaft portion. In a second preferred embodiment, each shaft extension is a threaded extension integral with the respective threaded shaft portion and mounting a nut which is rotatable to releasably clamp the respective roller support bracket between the extension nut and the nut on the adjacent threaded roller shaft portion. In a third preferred embodiment, the rollers are secured against rotation by clamp pins intersecting the roller shafts. The roller tube ends are preferably sealed against passage of liquid into the tube interior.

When a printing screen is stretched on a stretch frame according to the invention, the edgewise tension in the screen tends to bend or bow the frame rollers and thereby produce non-uniform tension in the screen. In relatively small frames the extent of such roller binding may be so small that the resulting non-uniform screen tension does not degrade the screen printing process. In relatively large frames, on the other hand, the rollers may bend to such an extent that the resulting non-uniform screen tension does adversely affect the printing results. A further feature of the invention resides in a tube-like reinforcing structure which may be placed in surrounding relation to a frame roller with the printing screen extending through a longitudinal opening in the structure for reinforcing the roller against bending and thereby minimizing or eliminating non-uniform tension in the screen. In its preferred form, this reinforcing structure is composed of at least a main reinforcing member for surrounding the roller and an additional reinforcing member which may be joined to the main member to increase its bending stiffness.

Yet another feature of the invention is concerned with an improved means for releasably but firmly securing a printing screen to the stretch frame rollers.

BRIEF DESCRIPTION OF THE DRAWINGS

FIG. 1 is a plan view of a presently preferred stretch frame structure according to the invention;

FIG. 1A is an enlarged fragmentary view of one corner of the frame in FIG. 1;

FIG. 2 is an enlarged section taken on line 2—2 in FIG. 1A;

FIG. 3 is a section taken on line 3—3 in FIG. 2;

FIG. 4 is a perspective view of a roller shaft embodied in the frame structure of FIGS. 1-3;

FIG. 5 is a section similar to FIG. 2 through a modified stretch frame according to the invention;

FIG. 6 is a section taken on line 6—6 in FIG. 5;

FIG. 7 is an enlargement of a portion of FIG. 6 illustrating the improved screen gripping means of the invention;

FIG. 8 is a view similar to FIG. 1A of a further modified stretch frame according to the invention;

FIG. 9 is a section taken on line 9—9 in FIG. 8;

FIG. 10 is a section taken on line 10—10 in FIG. 8;

FIG. 11 is an end view of a multi-member roller reinforcing structure according to the invention; and FIG. 12 illustrates a tool for use in securing a printing screen to the rollers of the present stretch frames.

DESCRIPTION OF PREFERRED EMBODIMENTS

Turning now to these drawings and first to FIGS. 1-4 there is illustrated an improved printing screen stretch frame structure 10 according to the invention mounting a printing screen 12. Frame 10 comprises four roller mounting brackets 14 situated at the four corners of a rectangle and rollers 16 disposed along the four sides of the rectangle with each roller extending endwise between the two adjacent brackets. At the ends of each roller 16 are coupling means 18 engaging and supporting the roller on the adjacent roller mounting brackets 14 in a manner to form a relatively rigid rectangular stretch frame structure. Rollers 16 have means 20 for gripping the edges of the screen 12 and means 22 for rotating the rollers to wind the screen on the rollers and thereby tension the screen. As will be explained, the roller coupling means 18 include means for securing the rollers against rotation relative to the roller mounting brackets 14 and thereby retaining the screen 12 in its stretched or taut condition.

As will be explained, when the rollers 16 are secured against rotation relative to the roller support brackets 14 to maintain the screen 12 taut, the rollers and brackets form a relatively rigid stretch frame structure 10. The frame structure comprises only the roller support brackets 14 and the rollers 16 including their coupling means 18 and is devoid of any means other than the rollers for joining the support brackets. This simple low cost frame structure contrasts markedly with conventional stretch frame structures, such as those disclosed in the earlier listed patents, in which the roller mounting brackets are mounted on a rigid rectangular frame or are otherwise joined into a rigid frame structure independently of the frame rollers.

Referring now in more detail to FIGS. 1-4, each roller supporting corner bracket 14 comprises a generally L-shaped bracket having two flat mutually perpendicular ends or arms 24 integrally joined at one end. The brackets may be cast or otherwise fabricated.

Each roller 16 comprises a hollow tube 26 with open ends. The coupling means 18 of each roller comprise plugs 28 which are pressed fitted into or otherwise secured within the open ends of the roller tube 26. Extending axially through these plugs coaxial with the roller tube are openings 30. The roller coupling means 18 further comprise shafts 32 including shaft portions 34 having inner ends which are pressed fitted into or otherwise rigidly secured within the plug openings 30 and outer threaded ends which extend coaxially beyond the ends of the roller tube 26. The roller shafts 32 have extensions 36 extending coaxially from the threaded shaft portions 34 and rotatably through arms 24 of the adjacent roller support brackets 14 to rotatably support the roller 16 on the adjacent brackets. Nuts 38 are threaded on the threaded shaft portions 34 at one side of the bracket arms 24. The shaft extensions 36 have shoulders 40 at the opposite sides of the bracket arms 24.

Nuts 38 provide shoulders about the threaded roller shaft portions 34 which, and the roller shaft extension shoulders 40 are relatively movable into and from clamping engagement with their intervening support bracket arms 14 to releasably secure the rollers 16 against rotation. Clamping engagement of these shoulders with the bracket arms also rigidly secures the roller brackets 14 and rollers 16 to one another to form the novel rigid stretch frame structure 10 having the advantages mentioned earlier.

The nuts 38 also provide the means 22 for rotating the rollers 16 to tension the printing screen 12. To this end, the two shaft portions 34 of each roller 16 are opposedly threaded in such a way that rotation of each nut 38 on its respective threaded shaft portion 34 in the direction which the roller turns to tension the screen advances the nut against the adjacent roller end. Thus, wrenches may be applied to the two nuts 38 of each roller 16 to first tighten the nuts against the roller ends and then rotate the roller in a direction to tension the screen 12.

In the embodiment of FIGS. 1-4, the shaft extensions 36 of each roller 16 comprise bolts which are coaxially threaded in the threaded roller shaft portions 34. The shaft extension shoulders 40 comprise the bolt heads. Washers 42 are welded or otherwise secured to the ends of the roller, tubes 26 and the roller coupling plugs 28 to seal the tube ends against passage of liquid into the tube interiors. The screen gripping means 20 of each roller 16 comprises a longitudinal slot 44 in the roller for receiving an edge fold of the screen and a retaining bar 46 positioned within the fold, and shoulders 48 along the slot sidewalls for retaining the bar in the slot with the screen gripped between the bar and the sidewalls.

The improved stretch frame 10 is used in much the same way as a conventional stretch frame by placing a printing screen over the frame, securing the screen edges to the rollers, and then turning the rollers to tension the screen. The rollers are then secured against rotation to retain the screen in its taut condition.

Turning next to FIGS. 5-7, the illustrated printing screen stretch frame structure 10*a* is essentially identical to that of FIGS. 1-4 except as noted below. Each roller end shaft extension 36*a* comprises a threaded shaft section integral with and extending coaxially from the respective threaded shaft portion 34*a*. This threaded shaft portion is fixed within a coaxial opening in an externally longitudinally grooved plug 28*a* fixed within the adjacent end of the roller tube 26*a*. The shoulder 40*a* on each roller shaft extension 36*a* is a nut threaded on the extension.

The screen gripping means 20*a* in each roller 16*a* comprises a recess 44*a* in the surface of and extending lengthwise of the roller. This recess has an open side along its length and a width below its open side which is less than the width of the open side. Positionable within the recess 44*a* are a pair of relatively stiff but somewhat resilient anchor rods 46*a* of NYLON or other suitable material. These rods have approximately the same diameter which approximates or just slightly exceeds one-half the width of the enlarged bottom portion of the recess 44*a* such that the rods may be placed side by side in the recess in the manner shown in FIG. 7. The depth of the recess is just slightly greater than the rod diameter. A printing screen 12 is secured to each roller 16*a* by tucking an edge of the screen into the recess 44*a*, then laying the anchor rods 46*a* over the screen along the recess, and finally forcing the rods through the narrow open side of the recess and into the wider bottom of the recess wherein the rods are confined by the overlying edges of the open recess side to grip the screen between the rods and recess walls.

FIG. 12 illustrates a tool 50 for thus forcing the anchor rods 46*a* into the roller recess 44*a*. This tool has a handle 52 mounting at one end a wheel 54 with two peripheral grooves 56 which are spaced and sized to receive the anchor rods 46*a* in FIGS. 6 and 7. The tool is used by engaging its wheel 54 with the anchor rods 46*a* in the manner shown in broken lines in FIG. 6 and then rolling the wheel along the rods while pressing down on the wheel to force the rods into the roller recess 44*a*.

FIGS. 8–10 illustrate a modified stretch frame structure 10*b* which is identical to that of FIGS. 5–7 except as noted below. Each roller shaft 32*b* has a threaded end of uniform diameter which extends from the roller 16*b* and rotatably through the respective roller support bracket arm 24*b*. The inner portion of this shaft adjacent the roller 16*b* comprises the threaded rod portion (not shown) on which is threaded the corresponding roller coupling nut 38*b*. The outer portion of the shaft is the shaft extension 36*b* on which is threaded the corresponding roller coupling nut 40*b*.

Each roller support bracket arm 24*b* contains a bore 58*b* intersecting the bore 60*b* through which the corresponding roller shaft 32*b* extends. Slideable in bore 58*b* is a clamp pin 62*b* having a recess 64*b* receiving the roller shaft. A nut 66*b* is threaded on the outer end of the pin to urge the pin outwardly and thereby rigidly clamp the roller shaft 32*b* and thereby also the respective roller 16*b* to the respective roller support bracket 14*b*.

As noted earlier, when a printing screen is stretched on a relatively large stretch frame, the frame rollers may bend sufficiently to create non-uniform tension in the screen of such magnitude as to significantly degrade any prints made from the screen. The frame structure 10*b* of FIGS. 8–10 embodies a reinforcing structure 66 for reinforcing one or more rollers 16*b* of the frame structure against such bending. This reinforcing structure comprises an elongate generally cylindrical longitudinal cavity 68 for receiving and having a diameter just slightly greater than the roller 16*b* to be reinforced. When the reinforcing structure or member 66 is mounted on a roller, it substantially surrounds the roller. The member has a channel-like cross section, such as that shown in FIG. 11, which provides the member with sufficient bending strength to support the reinforced roller against bending under the screen tension loads encountered in use of the stretch frame. The reinforcing member 66 has a longitudinal opening 70 in one side through which a printing screen may engage the roller. If desired, the reinforcing structure may include additional channel-like reinforcing members or sections 72 which may be welded or otherwise secured to the main member 66 to increase its bending strength.

The invention claims:

1. A stretch frame structure for stressing printing screen edgewise, comprising:

four corner brackets disposed at the four corners, respectively, of a rectangle, rollers disposed along the four sides, respectively, of the rectangle with each roller extending endwise between a respective pair of said corner brackets and including means for gripping an edge of a rectangular printing screen, coupling means at the ends of each roller engaging and rotatably supporting the roller of the respective corner brackets to form a relatively rigid, generally rectangular stretch frame structure, means for rotating said rollers to stress a gripped printing screen edgewise, and wherein said corner brackets are joined only by said rollers and roller coupling means, each corner bracket comprises an L-shaped member having a pair of mutually perpendicular arms integrally joined at one end, and said roller coupling means comprise coaxial shafts on the ends of each roller extending rotatably through adjacent arms of the respective corner brackets, and means for releasably rigidly securing said shafts to their respective bracket arms comprising a clamp pin extending through the respective corner bracket arm in intersecting relation to the respective roller shaft and having a laterally opening recess receiving the respective shaft, and means for moving said clamp pin axially to clamp and release the respective roller shaft.

2. In a stretch frame for stressing printing screen edgewise, the combination comprising:

a plurality of rollers each including a roller body, shafts extending coaxially from the ends of said body, and means on said roller body between said ends for gripping an edge of the screen, corner brackets rotatably engaging said roller shafts for rotatably supporting each of said rollers only at its ends for edgewise stressing of a screen secured to the rollers by rotation of the rollers in directions to wind the screen on the rollers.

a roller reinforcing structure separate from said brackets having a longitudinal cavity rotatably containing the body of one of said rollers with said reinforcing structure circumferentially surrounding and extending lengthwise of the body of said one roller and a longitudinal opening to said cavity thru which may extend a screen for attachment to said one roller, and said reinforcing structure being relatively rigid in a bending mode to reinforce said one roller against bending by edgewise tension from a stressed screen secured to said one roller.

3. The subject matter of claim 2, wherein:

said reinforcing structure comprises a tube-like main reinforcing member containing said cavity, and at least one additional reinforcing member to be secured to said main member for reinforcing said main member against bending.

4. A stretch frame structure for stressing printing screen edgewise, comprising:

four corner brackets disposed at the four corners, respectively, of a rectangle, rollers disposed along the four sides, respectively, of the rectangle with each roller extending endwise between a respective pair of said corner brackets and including means for gripping an edge of a rectangular printing screen, coupling means including coaxial shafts at the ends of each roller engaging and rotatably supporting the roller on the respective corner brackets at the roller ends only to form a relatively rigid generally rectangular stretch frame structure, whereby said corner brackets are joined only by said rollers and roller coupling means, means for rotating said rollers to stress a gripped printing screen edgewise, a roller reinforcing structure separate from said corner brackets circumferentially surrounding and extending lengthwise of at least one of said rollers with the respective roller rotatable within a longitudinal cavity in the structure and having a longitudinal opening to said cavity through which may extend a screen secured to the surrounded roller, and wherein said reinforcing structure is relatively rigid in a bending mode and reinforces said surrounded roller against bending by edgewise tension in a stressed screen secured to the surrounded roller.

5. The subject matter of claim 4, wherein:

said reinforcing structure comprises a tube-like main reinforcing member containing said cavity, and at least one additional reinforcing member to be secured to said main member for reinforcing said main member against bending.

6. A stretch frame structure for stressing printing screen edgewise, comprising:

rollers disposed along the four sides of a rectangle, bracket means including a pair of bracket arms at the ends, respectively, of each roller, each roller including a roller body, threaded shafts extending coaxially from the ends of said body and rotatably through the adjacent bracket arms to rotatably support the respective roller on the adjacent bracket arms, and means on said body for gripping an edge of a printing screen, each roller being rotatable in one direction to wind the screen on the respective roller and thereby tension the screen edgewise, nuts threaded on said shafts of each roller between the ends of the respective roller body and the adjacent bracket arms, the shafts of each roller being oppositely threaded such that rotation of the two nuts associated with each roller relative to their respective roller shafts in said one direction in which the roller turns to tension a screen urges the nuts against their adjacent ends of the respective roller body, and means for releasably securing each roller against rotation relative to its respective bracket arms.

7. A stretch frame structure according to claim 6 wherein:

said means for securing each roller against rotation comprises bolts threaded coaxially in said shafts of each roller and having heads, the bracket arms at the ends of each roller are disposed between the respective nuts and bolt heads, and the bolts on each roller are rotatable relative to their respective roller shafts to releasably engage their bolt heads with their adjacent bracket arms and thereby releasably secure the roller against rotation.

8. A stretch frame structure according to claim 7 wherein:

said means for securing each roller against rotation comprises second nuts threaded on said roller shafts outwardly of said first mentioned nuts, the bracket arms at the ends of each roller are disposed between the adjacent first and second nuts, and said second nuts on each roller are rotatable on their respective roller shafts to releasably engage the second nuts with their adjacent bracket arms and thereby releasably secure the roller against rotation.

9. A printing screen gripping roller for a stretch frame structure for stressing printing screen edgewise, comprising:

a roller body including means for gripping an edge of a printing screen, and threaded shafts extending coaxially from the ends of the roller body, nuts threaded on aid shafts, respectively, said roller shafts being oppositely threaded so that rotation of said nuts relative to their respective roller shafts in one and the same direction of rotation of said roller advances the nuts axially toward said roller body to limiting positions wherein further relative rotation of said nuts in said one direction relative to their respective roller shafts is prevented, whereby continued rotation of said nuts in said direction rotates said roller in said direction, and said nuts having means for rotating the nuts in said one direction of roller rotation to advance the nuts to said limiting positions and then rotate said roller in said direction.

10. A printing screen gripping roller according to claim 9 including:

a bolt coaxially threaded in each roller shaft.

11. A printing screen gripping roller according to claim 9 including:

second nuts threaded on said roller shafts outward of the first mentioned nuts.

12. A reinforced screen gripping roller assembly for a printing screen stretch frame structure, comprising:

a roller including a roller body, means on said body for gripping a printing screen, and shafts extending coaxially from the ends of said roller body, a roller reinforcing structure having a longitudinal cavity rotatably containing and circumferentially surrounding said roller body in reinforcing relation to the roller body and a longitudinal opening through which a printing screen is engagable with said screen gripping means, said reinforcing structure being relatively rigid in a bending mode, and said roller shafts extending from the ends of said reinforcing structure for rotatable engagement with roller supporting means separate from said reinforcing structure for rotatably supporting said roller only at its ends.

13. In a stretch frame for stressing printing screen edgewise, the combination comprising:

a roller including an elongate roller body, shafts extending coaxially from the ends of said body, and means on said roller body between said ends for gripping an edge of the screen, roller supporting means rotatably engaging said roller shafts and rotatably supporting said roller only at its ends for edgewise stressing of a screen secured to the roller by rotation of the roller in a direction to wind the screen on the roller, a roller reinforcing structure separate from said roller supporting means extending longitudinally of said roller, said reinforcing structure having a longitudinal cavity rotatably containing said roller body with said reinforcing structure circumferentially surrounding said roller body, and a longitudinal opening to said cavity thru which may extend a screen for attachment to the roller, and said reinforcing structure being relatively rigid in a bending mode to reinforce said roller against bending by edgewise tension from a stressed screen secured to the roller.

14. In a stretch frame structure for stressing printing screen edgewise, the combination comprising:

a roller including an elongate roller body, threaded shafts extending coaxially from the ends of said body, and means on said body for gripping an edge of the screen, roller supporting means rotatably engaging said roller shafts and rotatably supporting said roller for edgewise stressing of a screen secured to the roller by rotation of the roller, nuts threaded on said roller shafts said roller shafts being oppositely threaded so that rotation of said nuts relative to their respective roller shafts in one and the same direction of rotation of said roller advances the nuts axially along the shafts toward said roller body to limiting positions wherein further relative rotation of said nuts in said direction relative to their respective roller shafts is prevents, whereby continued rotation of said nuts in said direction rotates said roller in said direction and, said nuts having means for rotating the nuts in said one direction of roller rotation to advance the nuts to said limiting positions and then rotate said roller in said direction.

15. A stretch frame combination according to claim 14 including:

means for releasably securing said roller against rotation.

16. A stretch frame combination according to claim 15 wherein:

said roller supporting means comprise roller supports at the ends of said roller having inner sides facing one another axially of said roller and opposite outer sides, said roller shafts have axially outer ends accessible at said outer side of the respective roller supports, and said means for securing said roller against rotation comprise bolts threaded coaxially in said outer ends of said roller shafts and having heads at the outer sides of said roller supports engagable with the outer sides of said supports by rotation of said bolts relative to their respective shafts.

17. A stretch frame combination according to claim 15 wherein:

said roller supporting means comprise roller supports at the ends of said roller having inner sides facing one another axially of said roller and opposite outer sides, said roller shafts have axially outer ends accessible at said outer sides of the respective roller supports, and said means for securing said roller against rotation comprises second nuts threaded on said outer ends of said roller shafts at the outer sides of said supports and engagable with the outer sides of the supports by rotation of said second nuts relative to their respective shafts.

18. A stretch frame combination according to claim 14 wherein:

said nuts are located between the ends of said roller body and said roller supporting means.

19. In a stretch frame for stressing printing screen edgewise, the combination comprising:

a plurality of rollers each including a roller body, shafts extending coaxially from the ends of said body, and means on said roller body between said ends for gripping an edge of the screen, roller supporting means rotatably engaging said roller shafts for rotatably supporting said rollers only at their ends for edgewise stressing of a screen secured to the rollers by rotation of the rollers in directions to wind the screen on the rollers.

a roller reinforcing structure separate from said roller supporting means having a longitudinal cavity rotatably containing the body of one of said rollers with said reinforcing structure circumferentially surrounding and extending lengthwise of the body of said one roller, and a longitudinal opening to said cavity thru which may extend a screen for attachment to said one roller, and said reinforcing structure being relatively rigid in a bending mode to reinforce said one roller against bending by edgewise tension from a stressed screen secured to said one roller.

20. A stretch frame structure for stressing printing screen edgewise, comprising:

a plurality of rollers each including a roller body, means on said body for gripping edges of a printing screen, and threaded shafts extending coaxially from the ends of said body, roller supporting means rotatably engaging said roller shafts for rotatably supporting the respective rollers, nuts threaded on said shafts of each roller between the ends of the respective roller body and the respective roller supporting means, means for releasably securing each roller against rotation relative to said roller supporting means, each roller being rotatable in one direction to tension a screen secured to the respective roller, and said shafts of each roller being oppositely threaded so that rotation of the nuts on each roller relative to their respective roller shafts in the direction in which the respective roller turns to tension a screen advances the nuts axially toward the respective roller body to limiting positions wherein continued rotation of said nuts in said latter direction rotates the respective roller in said latter direction.

* * * * *